US009378903B2

(12) United States Patent
Hsu

(10) Patent No.: US 9,378,903 B2
(45) Date of Patent: Jun. 28, 2016

(54) KEYSWITCH STRUCTURE AND BALANCE LINK THEREOF

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Chien-Shih Hsu, Taoyua (TW)

(73) Assignees: DARFON ELECTRONICS (SUZHOU) CO., LTD., New District, Suzhou, Jiangsu Province (CN); DARFON ELECTRONICS CORP., Gueishan, Taoyuan (TW)

( * ) Notice: Subject to any disclaimer, the term of this patent is extended or adjusted under 35 U.S.C. 154(b) by 112 days.

(21) Appl. No.: 14/106,873

(22) Filed: Dec. 16, 2013

(65) Prior Publication Data

US 2014/0174900 A1 Jun. 26, 2014

(30) Foreign Application Priority Data

Dec. 20, 2012 (TW) ..... 101148651 A

(51) Int. Cl.
*H01H 13/70* (2006.01)
*H01H 3/12* (2006.01)
*H01H 13/7065* (2006.01)

(52) U.S. Cl.
CPC ..... *H01H 3/122* (2013.01); *H01H 13/7065* (2013.01); *H01H 2237/00* (2013.01)

(58) Field of Classification Search
CPC ..... H01H 3/12; H01H 3/122; H01H 3/125; H01H 13/705
USPC ..... 200/344, 345, 5 A; 400/490–496
See application file for complete search history.

(56) References Cited

U.S. PATENT DOCUMENTS

| | | | | |
|---|---|---|---|---|
| 5,941,373 | A | 8/1999 | Cheng | |
| 6,392,176 | B1 * | 5/2002 | Tsai | H01H 3/125 200/344 |
| 6,861,603 | B1 * | 3/2005 | Wang | H01H 3/122 200/344 |
| 7,842,895 | B2 * | 11/2010 | Lee | H01H 3/125 200/314 |
| 8,188,387 | B2 * | 5/2012 | Lo | H01H 3/122 200/5 A |
| 8,207,465 | B2 * | 6/2012 | Maruyama | H01H 3/125 200/344 |

(Continued)

FOREIGN PATENT DOCUMENTS

| | | | |
|---|---|---|---|
| CN | 2452119 | Y | 10/2001 |
| CN | 201112188 | Y | 9/2008 |

(Continued)

*Primary Examiner* — Kyung Lee
(74) *Attorney, Agent, or Firm* — Winston Hsu; Scott Margo

(57) ABSTRACT

A keyswitch structure includes a base plate, a keycap, a lift mechanism, and a balance link. The lift mechanism connects between the keycap and the base plate such that the keycap can move up and down relative to the base plate. The balance link is formed substantially in a U-shaped profile. The middle portion thereof is rotatably disposed on the base plate; the two ends thereof are respectively formed in an L-shaped profile and rotatably inserted into two slot structures on the keycap or the lift mechanism or both. Compared with a conventional balance link formed in an n-shaped profile connecting a keycap and a base plate, the invention provides more diverse structural connections, conducive to structural miniaturization. Furthermore, a support of the lift mechanism includes a protrusion capable of being blocked by a limitation structure disposed on the base plate for controlling the rotation angle of the support.

12 Claims, 9 Drawing Sheets

(56) References Cited

U.S. PATENT DOCUMENTS

| | | | | |
|---|---|---|---|---|
| 2004/0178051 | A1* | 9/2004 | Sato | H01H 3/125 200/344 |
| 2010/0294638 | A1* | 11/2010 | Maruyama | H01H 3/125 200/344 |
| 2011/0226600 | A1* | 9/2011 | Lo | H01H 3/122 200/5 A |
| 2014/0174900 | A1* | 6/2014 | Hsu | H01H 3/122 200/344 |

FOREIGN PATENT DOCUMENTS

| | | | |
|---|---|---|---|
| CN | 201655603 | U | 11/2010 |
| CN | 201663082 | U | 12/2010 |
| CN | 202258925 | U | 5/2012 |
| TW | M387357 | | 8/2010 |
| TW | 201042688 | | 12/2010 |
| TW | 201225132 | | 6/2012 |

* cited by examiner

KEYSWITCH STRUCTURE AND BALANCE LINK THEREOF

BACKGROUND OF THE INVENTION

1. Field of the Invention

The invention relates to a keyswitch structure, and especially relates to a keyswitch structure having a balance link and a balance link for a keyswitch structure.

2. Description of the Prior Art

The structure of conventional mechanical keyswitches is a keycap and a base plate with a lift mechanism therebetween such that the keycap is capable of moving up and down relative to the base plate. The movement stability, including movement stroke and even steadiness, of the keycap usually depends on the lift mechanism. If the movement of the lift mechanism itself is poor, the keycap can hardly move stably. Furthermore, if the length of the keycap such as space key is longer, a single lift mechanism cannot provide enough balance resilient force to the keycap leading to a slant easily when the keycap is pressed. Hence, in practice, the keycap with a longer length is usually provided with a plurality of lift mechanisms so that the resilient force produced after pressing the keycap is more balanced. However, in principle, each lift mechanism acts independently. Only by the structural constraint on one another through the keycap, the keycap still may slant after pressed in practice. For this problem, a common solution is using a balance link. The balance link is disposed independent of the lift mechanisms of the keyswitch structure. The balance link is provided in an n-shaped profile. The two ends thereof are movably connected to the base plate of the keyswitch structure; the middle portion thereof is rotatably connected to the bottom surface of the keycap of the keyswitch structure. Thereby, the balance link can constrain the up-and-down movement of the keycap to improve the movement stability. In general, for more constraint on the keycap by the balance link, the connection portion of the middle portion of the balance link with the keycap is as long as possible. In practice, the length of the middle portion is at least 70% of the length of the keycap. Because of the structural feature and the disposition of the lift mechanism and other components such as elastic domes (used for providing resilient force and triggering a switch) at the central portion of the keycap, the middle portion of the balance link cannot be disposed to pass through the central portion of the keycap. Hence, the middle portion of the balance link can be disposed only at a side portion of the keycap, so that the single balance link only constrains the keycap by a single side, which hardly provides effective constraint on the movement of the keycap. Furthermore, the conventional balance links are usually formed by bending flexible material. After several bending processes, the dimensions of the conventional balance link are easily out of precise control.

SUMMARY OF THE INVENTION

An objective of the invention is to provide a keyswitch structure, which uses a balance link to improve the movement stability of the keycap. The balance link has a U-shaped profile so that choosing a connection position of the balance link with the keycap is more flexible to improve the movement stability of the keycap further, which is also conducive to space usage and also to a design of structural miniaturization.

The keyswitch structure of the invention includes a base plate, a keycap, a lift mechanism, and a balance link. The base plate has an engagement structure. The keycap is disposed above the base plate. The lift mechanism is connected to and between the base plate and the keycap such that the keycap is capable of moving up and down relative to the base plate through the lift mechanism. The lift mechanism has a first recess and a second recess disposed oppositely. The balance link has a first side rotatable arm, a second side rotatable arm, and a middle portion. The middle portion connects the first side rotatable arm and the second side rotatable arm such that the balance link is formed substantially in a U-shaped profile. The middle portion is rotatably disposed on the engagement structure. The first side rotatable arm includes an L-shaped end rotatably inserted into the first recess. The second side rotatable arm includes an L-shaped end rotatably inserted into the second recess. In practice, the first recess and the second recess cooperate with a bottom surface of the keycap to form two slots for the two L-shaped ends to insert. The top (i.e. the top surface) of the L-shaped end rotatably contacts against the keycap; the bottom of the L-shaped end rotatably contacts against the lift mechanism. When keycap is pressed down, the lift mechanism is pressed down directly by the L-shaped ends, which improves the movement stability of the lift mechanism so that the keycap can move up and down steadiness. Therefore, the keyswitch structure of the invention overcomes the difficulty that the conventional balance link cannot directly improve the movement stability of the lift mechanism under its structure limitation.

Another keyswitch structure of the invention includes a base plate, a keycap, a lift mechanism, and a balance link. The base plate has an engagement structure. The keycap is disposed above the base plate. The lift mechanism is connected to and between the base plate and the keycap such that the keycap is capable of moving up and down relative to the base plate through the lift mechanism. The lift mechanism has a first slot and a second slot disposed oppositely. The balance link has a first side rotatable arm, a second side rotatable arm, and a middle portion. The middle portion connects the first side rotatable arm and the second side rotatable arm such that the balance link is formed substantially in a U-shaped profile. The middle portion is rotatably disposed on the engagement structure. The first side rotatable arm includes an L-shaped end rotatably inserted into the first slot; the second side rotatable arm includes an L-shaped end rotatably inserted into the second slot. Similarly, the balance link is directly connected to the lift mechanism so as to improve the movement stability of the lift mechanism so that the keycap can move up and down steadiness. Therefore, the keyswitch structure of the invention overcomes the difficulty that the conventional balance link cannot directly improve the movement stability of the lift mechanism under its structure limitation.

Another keyswitch structure of the invention includes a base plate, a keycap, a lift mechanism, and a balance link. The base plate has an engagement structure. The keycap is disposed above the base plate and has a first connection slot and a second connection slot. The lift mechanism is connected to and between the base plate and the keycap such that the keycap is capable of moving up and down relative to the base plate through the lift mechanism. The balance link has a first side rotatable arm, a second side rotatable arm, and a middle portion. The middle portion connects the first side rotatable arm and the second side rotatable arm such that the balance link is formed substantially in a U-shaped profile. The middle portion is rotatably disposed on the engagement structure. The first side rotatable arm includes an L-shaped end rotatably inserted into the first connection slot; the second side rotatable arm includes an L-shaped end rotatably inserted into the second connection slot. Thereby, the balance link is capable of being unlimitedly connected to anywhere of the keycap by requirements of product designs, which is also conducive to improvement in the movement steadiness of the keycap and solves the problem that the conventional balance link is connected only to a side of the keycap under its structure limitation.

Another objective of the invention is to provide a keyswitch structure, which uses a limitation structure to limit a lifting range of the lift mechanism so as to improve the movement stability of the lift mechanism and further improve the up-and-down movement steadiness of the keycap. The keyswitch structure has a base plate, a keycap, a limitation structure, and a lift mechanism. The keycap is disposed above the base plate. The limitation structure is disposed on the base plate. The lift mechanism includes two supports. Each of the two supports is rotatably connected to and between the base plate and the keycap such that the keycap is capable of moving up and down relative to the base plate through the two supports. The support includes a protrusion capable of been blocked by the limitation structure for controlling an angle of rotating of the support relative to the base plate. Thereby, the lift mechanism can move within a specific up-and-down movement range not by a structural constraint produced by the connection of the lift mechanism with the keycap and the base plate, which is conducive to improvement in the movement stability and also to improvement the up-and-down movement steadiness.

Another objective of the invention is to provide a balance link which includes a first side rotatable arm, a second side rotatable arm, and a middle portion. The middle portion connects the first side rotatable arm and the second side rotatable arm such that the balance link is formed substantially in a U-shaped profile. Therein, the balance link is formed by cutting a plate material. Thereby, the dimension tolerance of the balance link can be smaller than that of the conventional balance link formed by bending rod material, which is conducive to improvement in the assembly precision and movement precision and also to a structural miniaturization of the keyswitch structure. When in use, the middle portion is rotatably disposed on an engagement structure of a base plate. Two ends of the first side rotatable arm and the second side rotatable arm are formed in L-shaped ends correspondingly rotatably inserted into two slot structures oppositely disposed on a keycap or a lift mechanism or on the both, which can perform improvement in the movement steadiness of the keycap.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
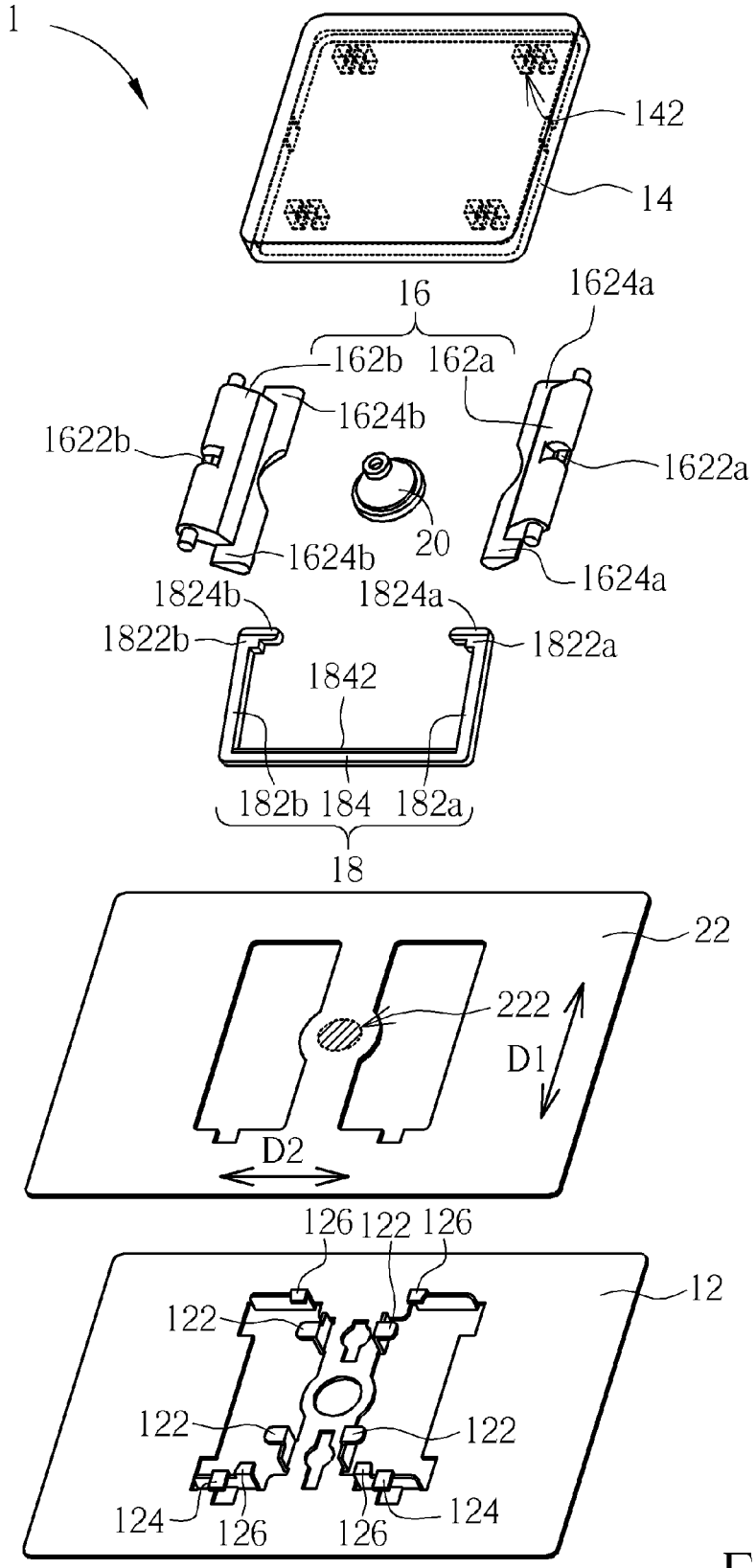
FIG. 1 is an exploded view of a keyswitch structure of an embodiment according to the invention.
Figure 2:
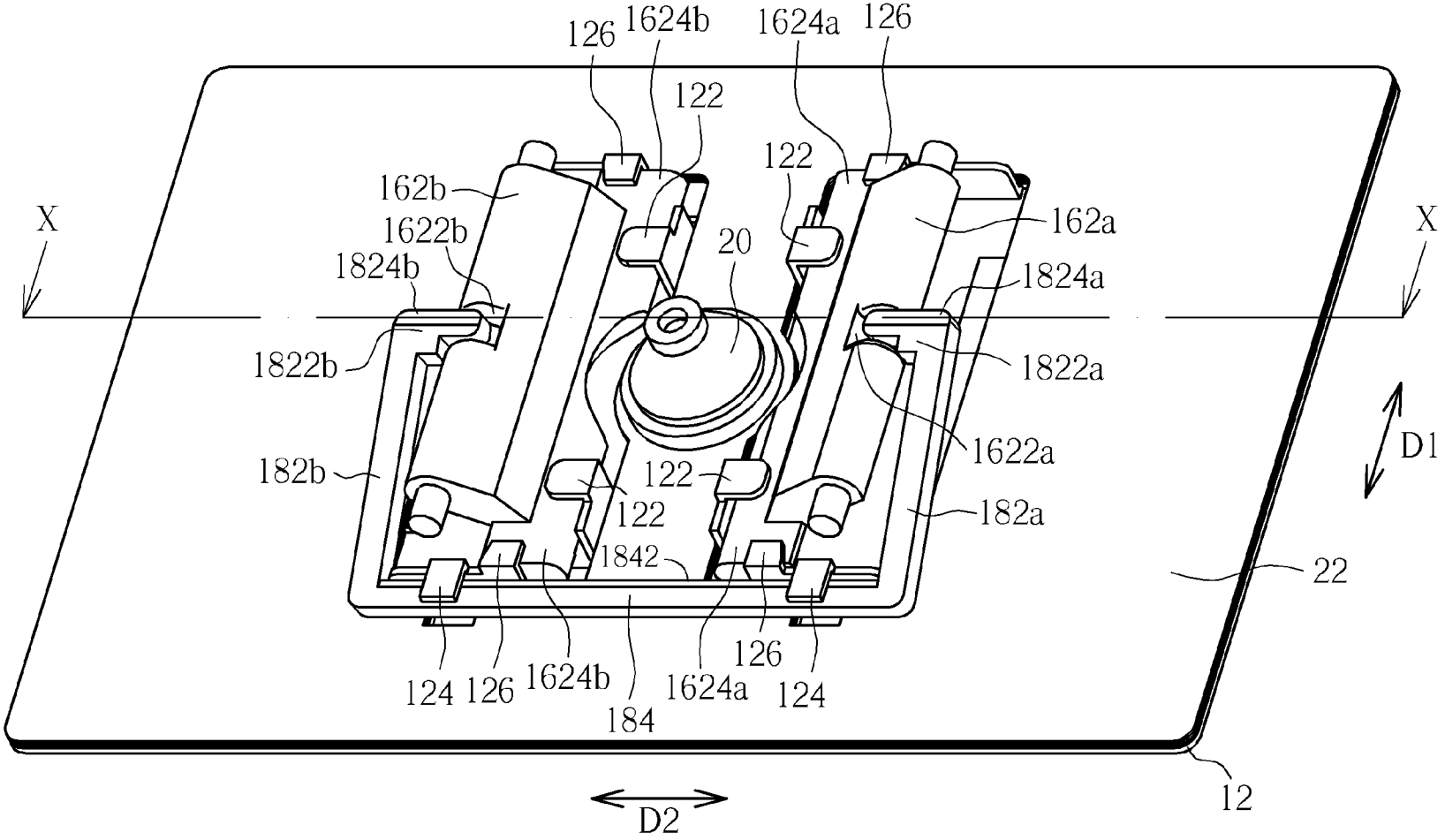
FIG. 2 is an assembly drawing of the keyswitch structure in FIG. 1.
Figure 3:
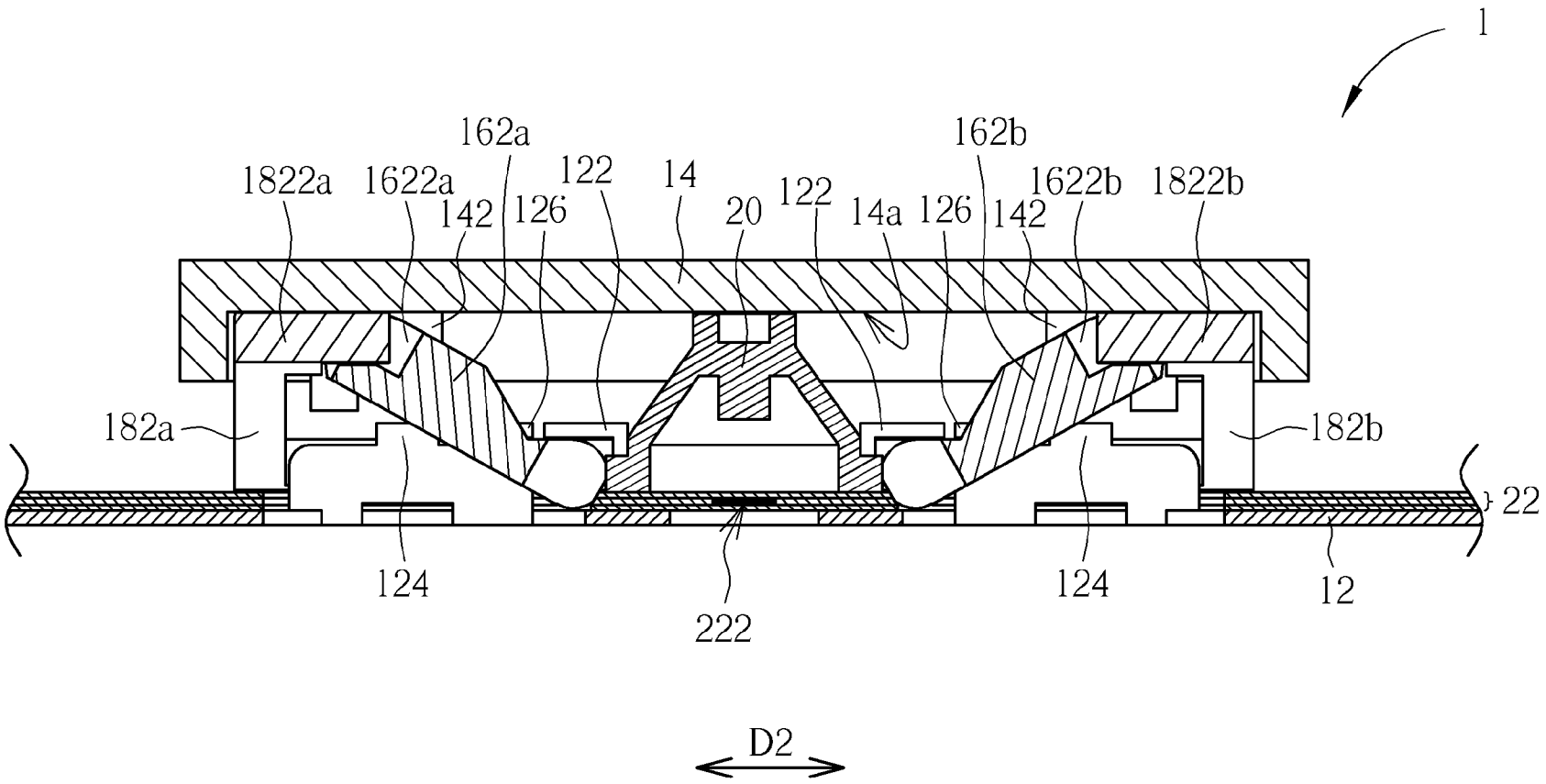
FIG. 3 is a sectional view of the keyswitch structure in FIG. 2 along the line X-X.

Please refer to FIGS. 1 through 3. FIG. 1 is an exploded view of a keyswitch structure 1 of an embodiment according to the invention. FIG. 2 is an assembly drawing of the keyswitch structure 1. FIG. 3 is a sectional view of the keyswitch structure 1 along the line X-X in FIG. 2. The keyswitch structure 1 includes a base plate 12, a keycap 14, a lift mechanism 16, a balance link 18, an elastic dome 20, and a membrane circuit board 22. Therein, in FIG. 2, for clear illustration of the keyswitch structure 1 after assembled, the keycap 14 is not shown. The keycap 14 is disposed above the base plate 12. The lift mechanism 16 is disposed between the base plate 12 and the keycap 14 and connected to engagement structures 122 of the base plate 12 and engagement structures 142 (shown in dashed lines in FIG. 1) on a bottom surface 14*a* of the keycap 14, such that the keycap 14 is capable of moving up and down relative to the base plate 12 through the lift mechanism 16. The lift mechanism 16 has a first recess 1622*a* and a second recess 1622*b* disposed oppositely. The balance link 18 has a first side rotatable arm 182*a*, a second side rotatable arm 182*b*, and a middle portion 184. The middle portion 184 connects the first side rotatable arm 182*a* and the second side rotatable arm 182*b* such that the balance link 18 is formed substantially in a U-shaped profile. The middle portion 184 is rotatably disposed on engagement structures 124 of the base plate 12. The first side rotatable arm 182*a* includes an L-shaped end 1822*a* rotatably inserted into the first recess 1622*a*. The second side rotatable arm 182*b* includes an L-shaped end 1822*b* rotatably inserted into the first recess 1622*b*. The top (i.e. the top surfaces) of each of the L-shaped ends 1822*a* and 1822*b* rotatably contacts against the keycap 14; the bottom of each of the L-shaped ends 1822*a* and 1822*b* rotatably contact against the recess 1622*a* or 1622*b* of the lift mechanism 16. When keycap 14 is pressed down, the lift mechanism 16 is pressed down directly by the L-shaped ends 1822*a* and 1822*b*, which improves the movement stability of the lift mechanism 16 so that the keycap 14 can move up and down steadiness. The membrane circuit board 22 is disposed above the base plate 12 and includes a switch 222 (of which the disposition position is indicated by a dashed circle in FIG. 1). The elastic dome 20 is disposed between the membrane circuit board 22 and the keycap 14 corresponding to the switch 222, such that when moving toward the base plate 12, the keycap 14 can press the elastic dome 20 to trigger the switch 222.

For further details, in the embodiment, the lift mechanism 16 includes a first support 162*a* and a second support 162*b*. Each of the first support 162*a* and the second support 162*b* is rotatably connected to and between the base plate 12 and the keycap 14. The first support 162*a* and the second support 162*b* are substantially symmetrically disposed at two sides of the elastic dome 20. The first support 162*a* and the second support 162*b* are not connected directly and are formed in a solid plate structure respectively. Therefore, both the first support 162*a* and the second support 162*b* have higher structural strength, conducive to improvement in movement steadiness. In the embodiment, the first support 162*a* and the second support 162*b* are pivotally connected to the engagement structures 142 of the keycap 14 and slidably connected to the engagement structure 122 of the base plate 12; however, the invention is not limited thereto. Furthermore, the lift mechanism of the invention can be realized by a conventional lift mechanism; the movement thereof is well-known by people having ordinary skill in the art and will not be described herein. In addition, in the embodiment, the base plate 12 includes four limitation structures 126. Each of the first support 162*a* and the second support 162*b* has protrusions 1624*a* and 1624*b* at its two sides. When the first support 162*a* and the second support 162*b* rotate up relative to the base plate 12, the limitation structures 126 can block the protrusions 1624*a* and 1624*b* for limiting an angle of rotating of the first support 162*a* and the second support 162*b* relative to the base plate 12, i.e. for controlling the angle of rotating. So the up-and-down movement stroke of the keycap 14 relative to the base plate 12 is constrained, which conducive to the steadiness of the up-and-down movement of the keycap 14. It is added that in the embodiment, there is no structure directly connecting the separate disposed first and second supports 162*a* and 162*b*, so the disposition of hollow structures can be reduced, which is conducive to improvement in structural strength. Therefore, compared with a scissors lift mechanism, the structural size of the lift mechanism 16 of the embodiment can be smaller but still with maintaining the needed structural strength, which is conducive to a structural miniaturization of the keyswitch structure 1.

In the embodiment, the first recess 1622*a* and the second recess 1622*b* are formed on the top of the first support 162*a* and the second support 162*b* respectively and cooperate with the bottom surface 14*a* of the keycap 14 to form slots respectively. The L-shaped ends 1822*a* and 1822*b* are inserted into the slots respectively, such that the first side rotatable arm 182*a* is rotatably connected to the first support 162*a*, and the second side rotatable arm 182*b* is rotatably connected to the second support 162*b*. In practice, the keycap 14 can form recess structures on the bottom surface 14*a* corresponding to the first recess 1622*a* and the second recess 1622*b* so as to cooperate with the first recess 1622*a* and the second recess 1622*b* to form slots for reducing disadvantageous influence of the first recess 1622*a* and the second recess 1622*b* on the structural strength of the first support 162*a* and the second support 162*b*. Such slot design is conducive to enhance flexibility of the engagements between the members. The engagement structures 124 of the base plate 12 are formed in slot structures. The middle portion 184 is slidably disposed in the engagement structures 124. When the keycap 14 moves up and down, the L-shaped ends 1822*a* and 1822*b* rotate in the first recess 1622*a* and the second recess 1622*b* respectively, and the middle portion 184 rotates and slides in the engagement structure 124. Thereby, the balance link 18 can directly constrain the lift mechanism 16 such that the first support 162*a* and the second support 162*b* move synchronously for keeping the keycap 14 moving up and down steadily. In addition, in practice, if the structural size of the keyswitch structure 1 is smaller, the balance link 18 can be formed by cutting a plate material, for example by a pressing process. The dimensional precision is much controllable relative to that by a bending process, so more precise dimensions can be obtained. It is added that if the balance link 18 is made by a plate material, a chamfer surface can be formed on the balance link 18 where the balance link 18 contacts other members for enhancing movement smoothness. In the embodiment, the L-shaped ends 1822*a* and 1822*b* have chamfer surfaces 1824*a* and 1824*b* corresponding to the first recess 1622*a* and the second recess 1622*b* respectively such that the cross profile of the L-shaped ends 1822*a* and 1822*b* approximates to circle relatively, which is conducive to rotating of the L-shaped ends 1822*a* and 1822*b* in the first recess 1622*a* and the second recess 1622*b*. The middle portion 184 has a chamfer surface 1842 corresponding to the engagement structure 124, which is conducive to sliding and rotating of the middle portion 184 in the engagement structure 124. In practice, the chamfer surfaces 1824*a*, 1824*b* and 1842 also can be formed in a pressing process.

In the embodiment, the first support 162*a* and the second support 162*b* are rotatable parallel to a first direction D1 relative to the base plate 12, so the movement balance of the keycap 14 in the first direction D1 is maintained by the lift mechanism 16. The middle portion 184 is rotatable parallel to a second direction D2 relative to the base plate 12, so the movement balance of the keycap 14 in the second direction D2 is maintained by the balance link 18. Therein, the first direction D1 is perpendicular to the second direction D2, so the keycap 14 can move up and down relative to the plane parallel to the first direction D1 and the second direction D2 (i.e. relative to the base plate 12) steadily. It is added that in principle, as long as the first direction D1 and the second direction D2 are not parallel, a planar constraint can be formed for movement balance of the keycap 14 moving up and down relative to the plane; therefore, the invention is not limited to the case that the first direction D1 and the second direction D2 are perpendicular to each other in the embodiment. In addition, in the embodiment, the base plate 12 and the engagement structures 122, 124 and 126 are integrated to be formed in one piece, for example by pressing and bending a plate material; however, the invention is not limited thereto.

Figure 4:
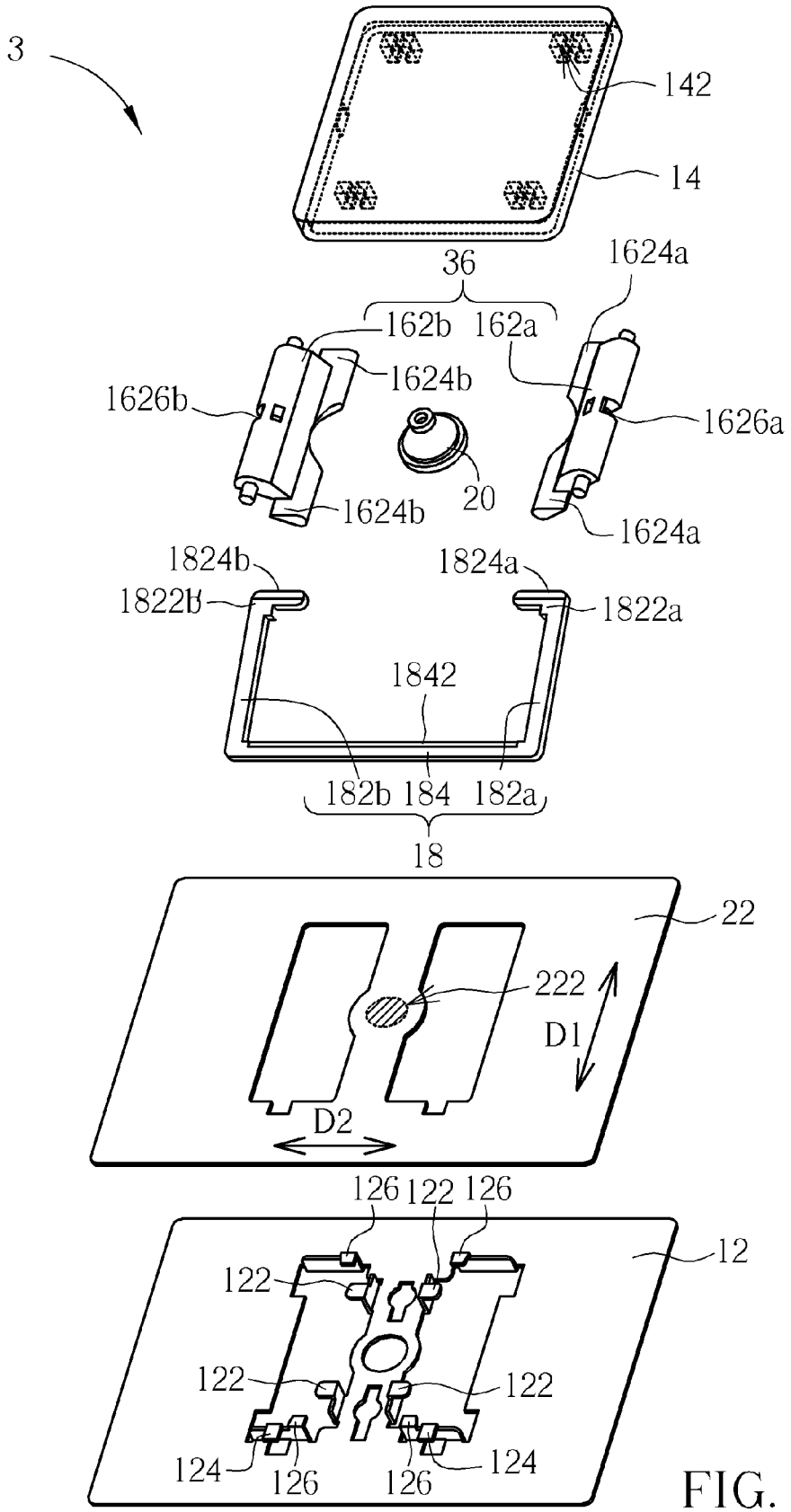
FIG. 4 is an exploded view of a keyswitch structure of another embodiment according to the invention.
Figure 5:
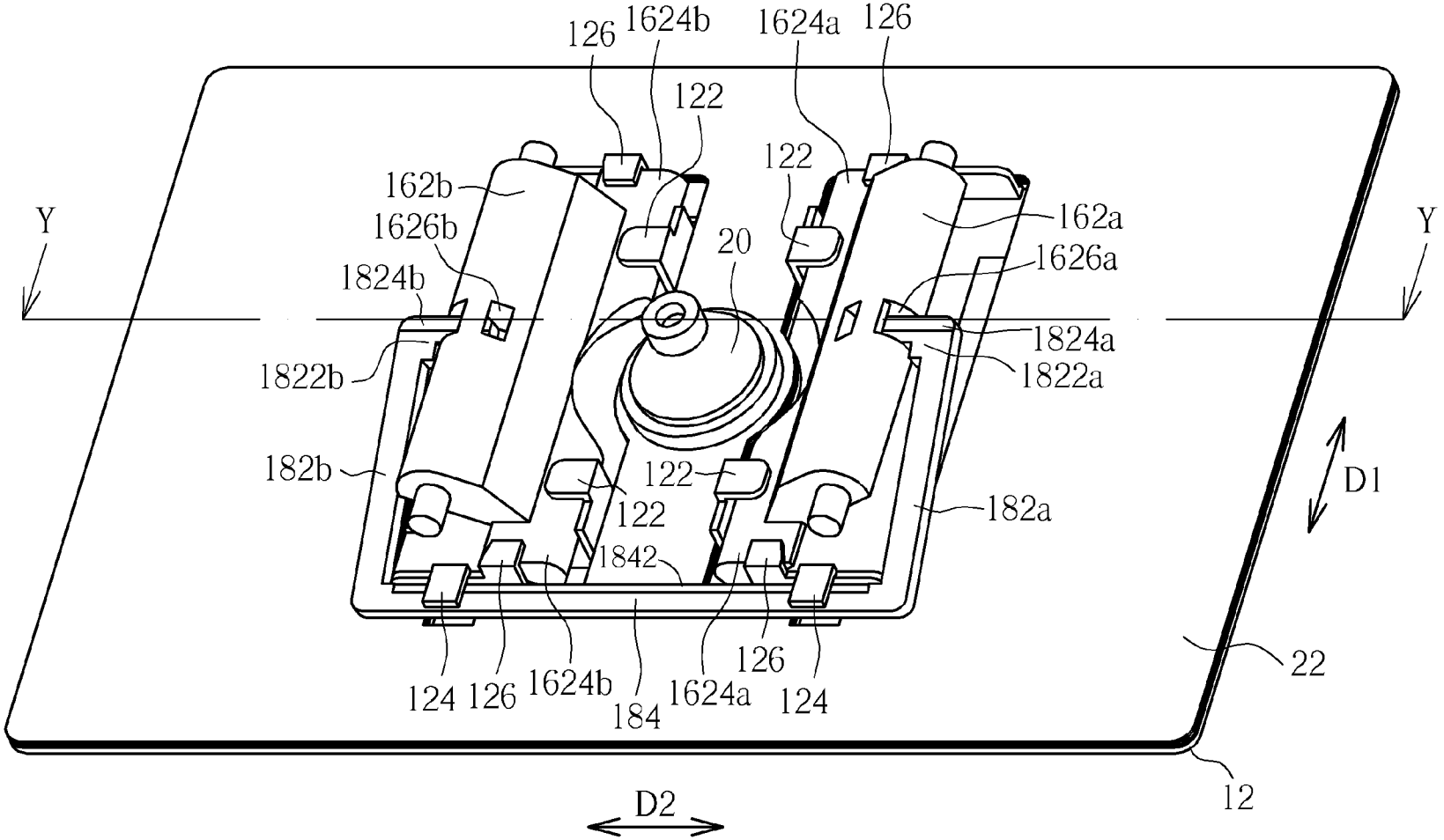
FIG. 5 is an assembly drawing of the keyswitch structure in FIG. 4.
Figure 6:
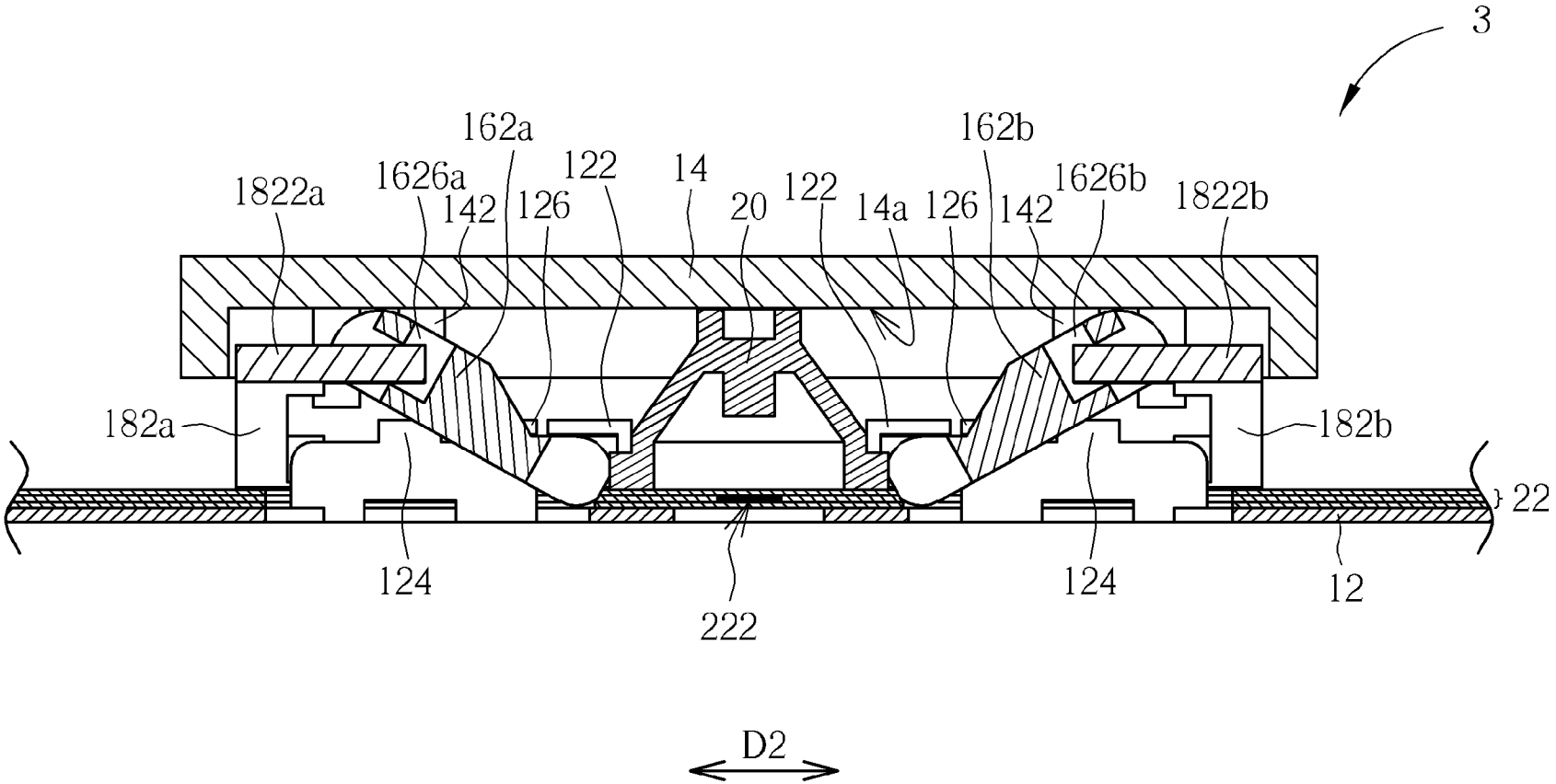
FIG. 6 is a sectional view of the keyswitch structure in FIG. 5 along the line Y-Y.

In the above embodiment, the L-shaped ends 1822*a* and 1822*b* of the balance link 18 can be regarded as being disposed between the lift mechanism 16 and the keycap 14 in logic, but the invention is not limited thereto. Please refer to FIGS. 4 through 6. FIG. 4 is an exploded view of a keyswitch structure 3 of another embodiment according to the invention. FIG. 5 is an assembly drawing of the keyswitch structure 3. FIG. 6 is a sectional view of the keyswitch structure 3 along the line Y-Y in FIG. 5. The keyswitch structure 3 is structurally similar to the keyswitch structure 1, so the keyswitch structure 3 still uses the component notations of the keyswitch structure 1. In addition, in FIG. 5, for clear illustration of the keyswitch structure 3 after assembly, the keycap 14 is not shown. The main difference between the keyswitch structure 3 and the keyswitch structure 1 is that in the keyswitch structure 3, the lift mechanism 36 has a first slot 1626*a* and a second slot 1626*b* disposed oppositely and formed on the first support 162*a* and the second support 162*b* respectively. The first slot 1626*a* and the second slot 1626*b* replace the first recess 1622*a* and the second recess 1622*b* in the keyswitch structure 1. The first side rotatable arm 182*a* and the second side rotatable arm 182*b* are rotatably connected to the first support 162*a* and the second support 162*b* by inserting the L-shaped ends 1822*a* and 1822*b* into the first slot 1626*a* and the second slot 1626*b* respectively. Similarly, the balance link 18 can constrain the lift mechanism 36 directly such that the first support 162*a* and the second support 162*b* move synchronously for also keeping the keycap 14 connected to the lift mechanism 36 moving up and down steadily. For other descriptions of the components of the keyswitch structure 3, please refer to relevant descriptions of the keyswitch structure 1; they will not be described in addition. It is added that in the embodiment, the L-shaped ends 1822*a* and 1822*b* of the balance link 18 of the keyswitch structure 3 are engaged only with the first support 162*a* and the second support 162*b*, so the balance link 18 can be assembled compactly with the lift mechanism 36, which is conducive to synchronous movement of the first support 162*a* and the second support 162*b*. In addition, in the embodiment, the first slot 1626*a* and the second slot 1626*b* are through holes, but the invention is not limited thereto.

Figure 7:
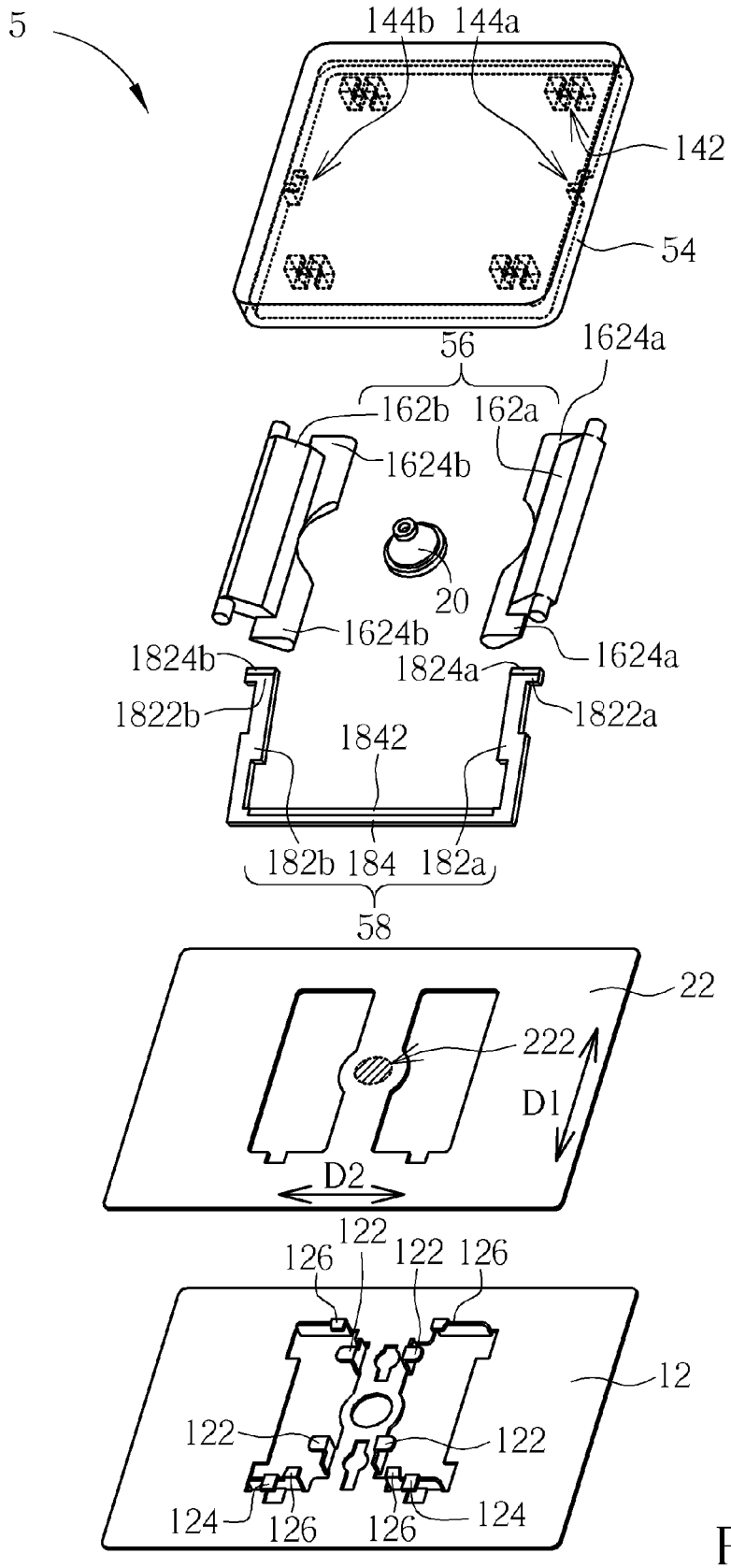
FIG. 7 is an exploded view of a keyswitch structure of another embodiment according to the invention.
Figure 8:
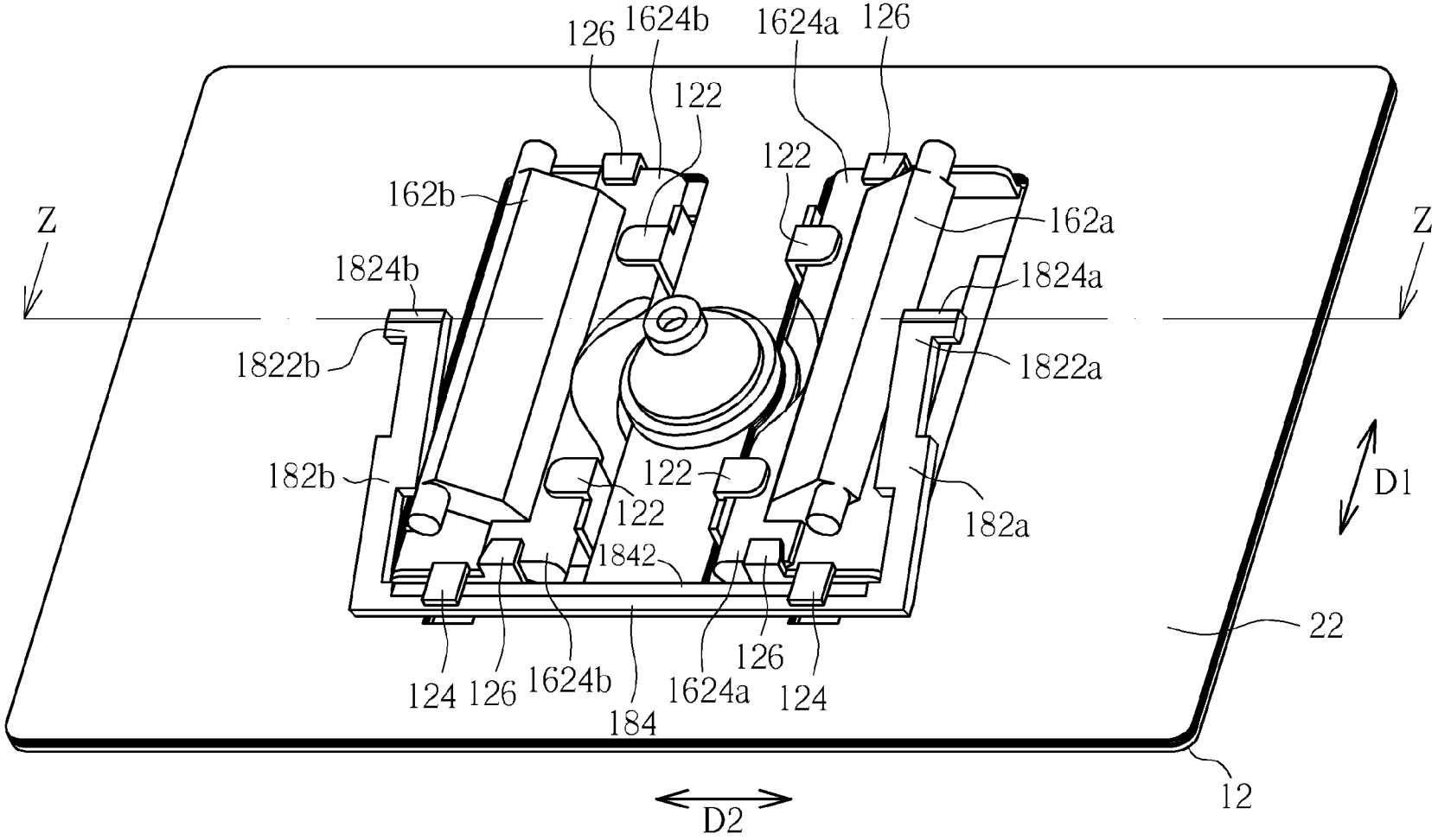
FIG. 8 is an assembly drawing of the keyswitch structure in FIG. 7.
Figure 9:
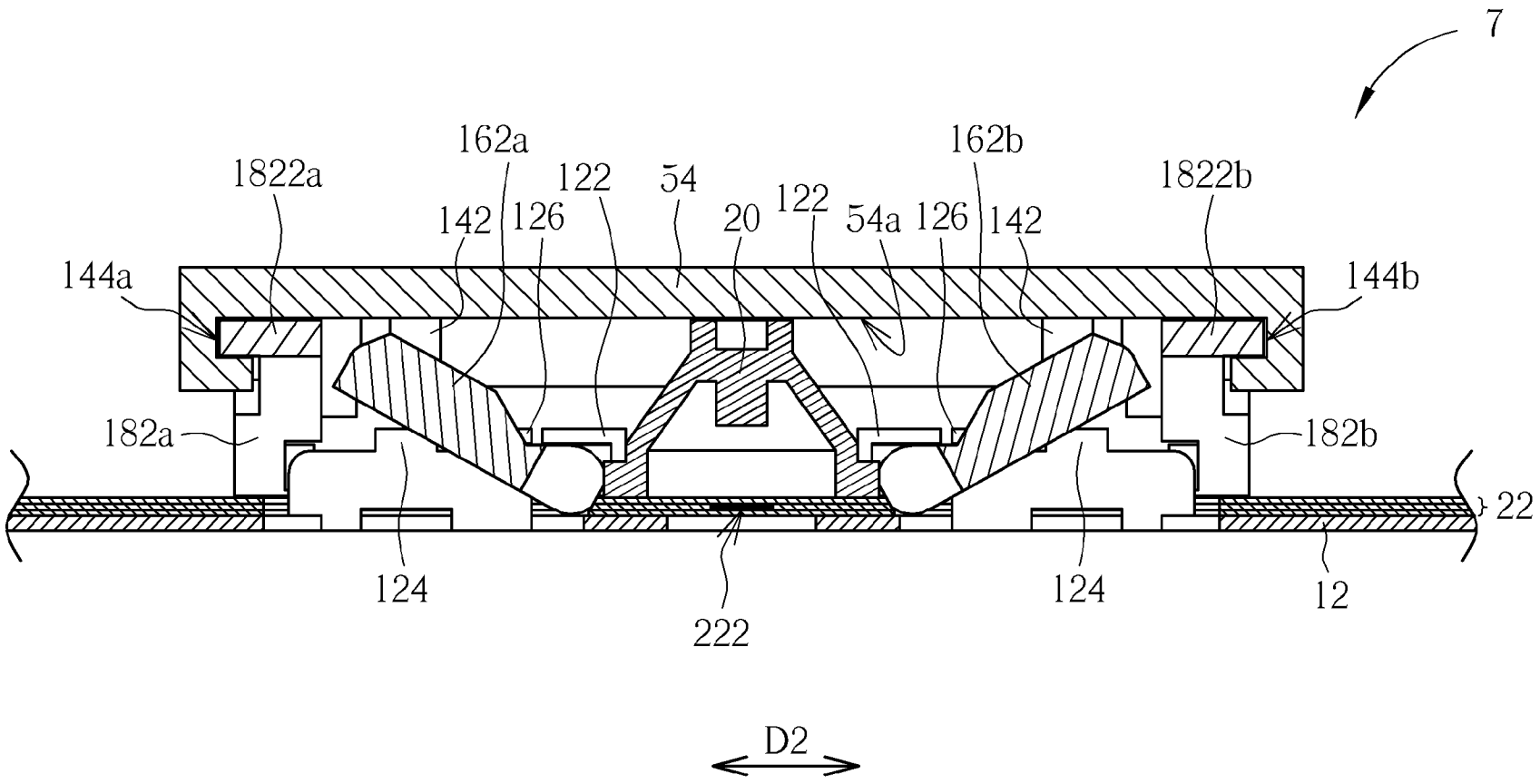
FIG. 9 is a sectional view of the keyswitch structure in FIG. 8 along the line Z-Z.

As discussed for the above embodiments, the L-shaped ends 1822*a* and 1822*b* of the balance link 18 are directly connected to the lift mechanisms 16 and 36 so as to obtain synchronous movement of the first support 162*a* and the second support 162*b*; however, the invention is not limited thereto. Please refer to FIGS. 7 through 9. FIG. 7 is an exploded view of a keyswitch structure 5 of another embodiment according to the invention. FIG. 8 is an assembly drawing of the keyswitch structure 5. FIG. 9 is a sectional view of the keyswitch structure 5 along the line Z-Z in FIG. 8. The keyswitch structure 5 is structurally similar to the keyswitch structure 1, so the keyswitch structure 5 still uses the component notations of the keyswitch structure 1. In addition, in FIG. 8, for clear illustration of the keyswitch structure 3 after assembly, the keycap 54 of the keyswitch structure 5 is not shown. The main difference between the keyswitch structure 3 and the keyswitch structure 1 is that in the keyswitch structure 1, the L-shaped ends 1822*a* and 1822*b* of the balance link 18 extends toward the inside of the balance link 18; on the contrary, in the keyswitch structure 5, the L-shaped ends 1822*a* and 1822*b* of the balance link 58 extends outwards from the balance link 58, and the L-shaped ends 1822*a* and 1822*b* are engaged only with the keycap 54. Thereby, the balance link 58 directly controls the movement balance of the keycap 54 in the second direction D2.

For further details, in the embodiment, the keycap 54 has a first connection slot 144*a* and a second connection slot 144*b* (shown by dashed lines in FIG. 7) on the bottom surface 54*a*. The L-shaped ends 1822*a* and 1822*b* rotatably inserted into the first connection slot 144*a* and the second connection slot 144*b* respectively, such that the first rotatable arm 182*a* and the second side rotatable arm 182*b* of the balance link 58 are capable of rotating relative to the keycap 54. In the embodiment, each of the first connection slot 144*a* and the second connection slot 144*b* is realized by an L-shaped slide disposed at the middle portion of the keycap 54; however, the invention is not limited thereto. For other descriptions of the components of the keyswitch structure 5, please refer to relevant descriptions of the keyswitch structure 1; they will not be described in addition. It is added that in the embodiment, the first connection slot 144*a* and the second connection slot 144*b* are disposed at the skirt portion of the keycap 54, which is conducive to compact structural configuration of the keyswitch structure 5 and miniaturization design. Furthermore, the lift mechanism 56 of the keyswitch structure 5 needs no structures for engaging with the balance link 58, so the structural strength of the lift mechanism 56 can be enhanced further, which is conducive to improvement in the movement steadiness of the lift mechanism 56.

As discussed for the embodiments, the connection portions of the balance link with the lift mechanism or the keycap of the invention can just be two L-shaped ends, which there is no direct connection structure between, so even when the two L-shaped ends are disposed at two sides of the elastic dome (i.e. a line segment bounded by the two L-shaped ends passing through the elastic dome), the two L-shaped ends will not interfere with the elastic dome to affect the movement of the elastic dome. In a conventional keyswitch structure, its balance link can be engaged with only one side of the keycap for avoiding any interference with other components, leading to that the balance link can hardly constrain the movement of the keycap efficiently. On the contrary, the determination of the connection portions of the balance link with the lift mechanism or the keycap of the invention is more flexible. In the above embodiment, the L-shaped ends 1822*a* and 1822*b* are located at the two sides of the elastic dome 20, and the projections thereof are located at the middle portion of the keycaps 14 and 54 for connecting the L-shaped ends 1822*a* and 1822*b* with the lift mechanisms 16 and 36 or the keycap 54 such that the balance links 18 and 58 perform constraint on the lift mechanisms 16 and 36 or the keycap 54 for the steady movement of the lift mechanisms 16 and 36 and the keycaps 14 and 54. But the invention is not limited thereto. Briefly, compared with the conventional keyswitch structure having a balance link, the keyswitch structure of the invention has a more flexible structural design because of the structural features of the balance link (i.e. being disposed in the U-shaped profile, different from being disposed in C-shaped profile), so as to obtain more steady movement and for miniaturization. In addition, the keyswitch structure of the invention can use the limitation effect by the limitation structure to the protrusion of the lift mechanism to limit the angle of rotating of the support of the lift mechanism relative to the base plate, so that the keycap can move up and down only within a certain movement range. Therefore, the keyswitch structure of the invention can provide the keycap a better steadiness in height and level of movement; that is, the keycap of the keyswitch structure of the invention has an omnidirectional movement steadiness.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a base plate having an engagement structure;

a keycap disposed above the base plate;

a lift mechanism connected to and between the base plate and the keycap such that the keycap is capable of moving up and down relative to the base plate through the lift mechanism, the lift mechanism having a first recess and a second recess disposed oppositely; and a balance link having a first side rotatable arm, a second side rotatable arm, and a middle portion, the middle portion connecting the first side rotatable arm and the second side rotatable arm such that the balance link is formed substantially in a U-shaped profile, the middle portion being rotatably disposed on the engagement structure, the first side rotatable arm comprising an L-shaped end rotatably inserted into the first recess, the second side rotatable arm comprising an L-shaped end rotatably inserted into the second recess.

2. The keyswitch structure of claim 1, wherein the lift mechanism comprises a first support and a second support, each of the first support and the second support is rotatably connected to the base plate and the keycap, the first side rotatable arm is rotatably connected to the first support, and the second side rotatable arm is rotatably connected to the second support.

3. The keyswitch structure of claim 2, wherein the first support and the second support are rotatable parallel to a first direction relative to the base plate, the middle portion is rotatable parallel to a second direction relative to the base plate, and the first direction is perpendicular to the second direction.

4. The keyswitch structure of claim 2, wherein the first support comprises a protrusion, and the base plate comprises a limitation structure capable of blocking the protrusion for controlling an angle of rotating of the first support relative to the base plate.

5. The keyswitch structure of claim 1, wherein the balance link is formed by cutting a plate material.

6. A keyswitch structure, comprising:

a base plate;

a keycap disposed above the base plate;

a limitation structure disposed on the base plate; and a lift mechanism comprising two supports, each of the two supports being rotatably connected to and between the base plate and the keycap such that the keycap is capable of moving up and down relative to the base plate through the two supports, the support comprising a protrusion capable of been blocked by the limitation structure for controlling an angle of rotating of the support relative to the base plate.

7. The keyswitch structure of claim 6, further comprising a balance link having a first side rotatable arm, a second side rotatable arm, and a middle portion, the middle portion connecting the first side rotatable arm and the second side rotatable arm such that the balance link is formed substantially in a U-shaped profile, the middle portion being rotatably disposed on the base plate.

8. The keyswitch structure of claim 7, wherein the first side rotatable arm and the second side rotatable arm are rotatably connected to the two supports respectively, the two supports are rotatable parallel to a first direction relative to the base plate, the middle portion is rotatable parallel to a second direction relative to the base plate, and the first direction is perpendicular to the second direction.

9. The keyswitch structure of claim 7, wherein the two supports have a first slot and a second slot respectively, the first slot and the second slot are disposed oppositely, the first side rotatable arm comprises an L-shaped end rotatably inserted into the first slot, and the second side rotatable arm comprises an L-shaped end rotatably inserted into the second slot.

10. The keyswitch structure of claim 7, wherein the two supports have a first recess and a second recess respectively, the first recess and the second recess are disposed oppositely and cooperate with a bottom surface of the keycap to form a first slot and a second slot respectively, the first side rotatable arm comprises an L-shaped end rotatably inserted into the first slot, and the second side rotatable arm comprises an L-shaped end rotatably inserted into the second slot.

11. The keyswitch structure of claim 7, wherein the base plate comprises an engagement structure, and the middle portion has a chamfer surface engaged with the engagement structure.

12. The keyswitch structure of claim 7, wherein the balance link is formed by cutting a plate material.

* * * * *